US011859402B1

(12) United States Patent
Duncan

(10) Patent No.: US 11,859,402 B1
(45) Date of Patent: Jan. 2, 2024

(54) POST DRIVING GUIDE

(71) Applicant: Jeff R Duncan, Austin, TX (US)

(72) Inventor: Jeff R Duncan, Austin, TX (US)

( * ) Notice: Subject to any disclaimer, the term of this patent is extended or adjusted under 35 U.S.C. 154(b) by 0 days.

(21) Appl. No.: 18/103,239

(22) Filed: Jan. 30, 2023

(51) Int. Cl.
*E04H 17/26* (2006.01)

(52) U.S. Cl.
CPC ..... *E04H 17/263* (2013.01)

(58) Field of Classification Search
CPC ..... E04H 17/263
See application file for complete search history.

(56) References Cited

U.S. PATENT DOCUMENTS 1,219,606 A * 3/1917 Kane ..... B60T 15/306 303/46
1,722,352 A * 7/1929 Rawley ..... E04H 12/2253 52/298
2,849,202 A * 8/1958 Mccombs ..... E04H 12/2238 248/524
5,002,252 A * 3/1991 Setala ..... A47G 33/12 248/533
5,104,074 A * 4/1992 Malloy ..... E04H 12/2215 52/156
6,419,201 B1 * 7/2002 Hughes, Jr. ..... F16M 11/242 248/514
6,684,580 B1 * 2/2004 Hull ..... F16M 11/16 256/64
9,732,540 B1 * 8/2017 Jansen ..... E04H 17/26
10,036,180 B1 * 7/2018 Jansen ..... E04H 17/22
10,063,180 B2 * 8/2018 Wang ..... H02K 16/04
2004/0004168 A1 * 1/2004 Crain ..... F16M 11/16 248/176.1

* cited by examiner

*Primary Examiner* — Seahee Hong
(74) *Attorney, Agent, or Firm* — Joe D. Calhoun

(57) ABSTRACT

An apparatus including mechanisms for holding or guiding a fence post (or other type of post), in an essentially vertical orientation and in a relatively loose manner so that the apparatus can readily be removed part way through the post-driving activity and so that the downward driving force does not damage the apparatus. The apparatus is expandable from a compact transport configuration to a free-standing use configuration, and includes an assembly head having a connecting means for connecting a pair of pivotable 1st and 2nd support legs (each having a foot end and having an apex end pivotably connected to the assembly head and essentially opposing the apex end of the other support leg); a 3rd pivotable support leg having a 3rd foot end and a 3rd apex end pivotably connected to the assembly head (and enabling the apparatus to stand when all three support legs are pivoted outwardly); and a stabilizer support downstanding from the assembly head, and including a lower connection end. The apparatus also includes a stabilizer guide member having a middle portion pivotably connected to said lower connection end of said stabilizer support; a stabilizer end pivotably connected to said 3rd support leg; and an opposite guide end defining an aperture sized to accept insertion of the fence post in a manner positioning it essentially vertically for commencement of the user manually driving it into the ground but facilitating lifting of the apparatus off the partially driven post without altering the vertical positioning thereof.

17 Claims, 14 Drawing Sheets

POST DRIVING GUIDE

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION

(1) Field of the Invention

The present invention relates to mechanisms for holding or guiding a fence post (or other type of post) in an essentially vertical orientation, facilitating the driving of the post into the ground. More particularly, the invention disclosed herein relates to devices holding or guiding the post vertically, in a relatively loose manner so that the downward driving force does not damage the device, and so that the device can readily be removed part way through the post-driving activity so that the driving can be completed without endangering the device.

(2) Background of the Invention

Post driving and pile driving devices have been known for years.

U.S. Pat. No. 6,719,261 issued to Wadsworth (entitled Post Support Apparatus) discloses a mobile apparatus for supporting a metal post while it is being driven into the ground, utilizing a base plate having a tubular guide member for holding the post in a steady condition while the post is being driven into the ground. The post is insertable endwise into the tube and is engageable with the ground through a through-opening cut in the base plate; one embodiment includes an aperture having a T-shape, for insertion of a T-post through the base plate. As a user stands upon or beside the base with his feet positioned on opposite sides of the through-opening, both of his hands are free to use a driver to drive the post into the ground.

U.S. Pat. No. 6,517,294 issued to Vreeland (entitled Apparatus for Installing a Silt Fence) discloses a stake driving device including a vertical tube within another tube which is rigidly connected to the side of a tractor, for positioning fence stakes point-down towards the ground while being driven into the ground. With the tractor stopped at the desired place for fence stake placement, the user inserts a stake point-down through the aligned slot openings of the inner tube and outer tube, which are located beneath a hydraulic piston ramming the stake into the ground. (See FIG. 10.)

U.S. Pat. No. 10,745,880 issued to West (entitled Guided Multiple Pile Driver System) discloses a system for simultaneously driving multiple piles into the ground to create A-frame type structures that are anchored by piles running at angles to one another and to the ground. The system comprises a guide assembly and an actuator for driving the piles into supporting ground at the same time. The actuator may engage slots or teeth in the pile to drive them into the ground and/or may apply torque and downward pressure. The guide assembly may be a guide housing having open ends (the lowermost in contact with the ground), preventing escape of the piles while being forced into the ground, and guiding the orientation of the piles being driven into the ground. (See FIG. 4B.) The housing can be lifted off the piles after they are driven into the ground. Rather than being open-ended, the guide housing may have slots in those ends, through with piles may be inserted for vertical guidance. (See FIG. 12B.), U.S. Pat. No. 8,230,944 issued to Thiem (entitled Post Alignment Tool) discloses a tool known as a Post Pounder, having a paddle-like configuration including a plate having an aperture sized to closely accept insertion of T-post. The tool is used to apply radial torque to a post which has been driven into the ground, for aligning the T-post in an orientation similar to other nearby posts for a fence.

SUMMARY OF THE INVENTION

The invention disclosed herein is essentially an apparatus for positioning a fence post (or other post) vertically for manually driving it into the ground, comprising (including) a collapsible mobile tri-pod straddling a stabilizer paddle providing additional stability to the tri-pod while providing an adjustable aperture loosely capturing the post to position it vertically while the user commences driving the post into the ground. The invention also includes a way to easily remove the apparatus from the partially-driven post, so that the user can complete the driving without fear of an errant down-stroke of driving force that would impact and damage the apparatus.

One primary benefit of the disclosed invention is that the apparatus is readily transportable by hand, allowing the user to carry it and use it in places not readily reachable by vehicle.

Another benefit of the apparatus is that it is easily reconfigured from its compacted travel/storage configuration to its free-standing use configuration, without tools.

Another benefit of the apparatus is that it holds and guides posts of different thicknesses or dimensions, enabling the user to drive it into the ground without another person's assistance.

Another benefit of the apparatus is that it can be readily removed from the partially-driven post and set aside, so that the user can complete the driving without fear that an errant down-stroke of driving force will impact the apparatus and damage it.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages herein provided will become apparent to one with skill in the art upon examination of the accompanying Figures and detailed description. It is intended that all such additional systems, methods, features and advantages that are included within this description, be within the scope of any claims filed now or later.

DETAILED DESCRIPTION OF THE INVENTION

Figure 1:
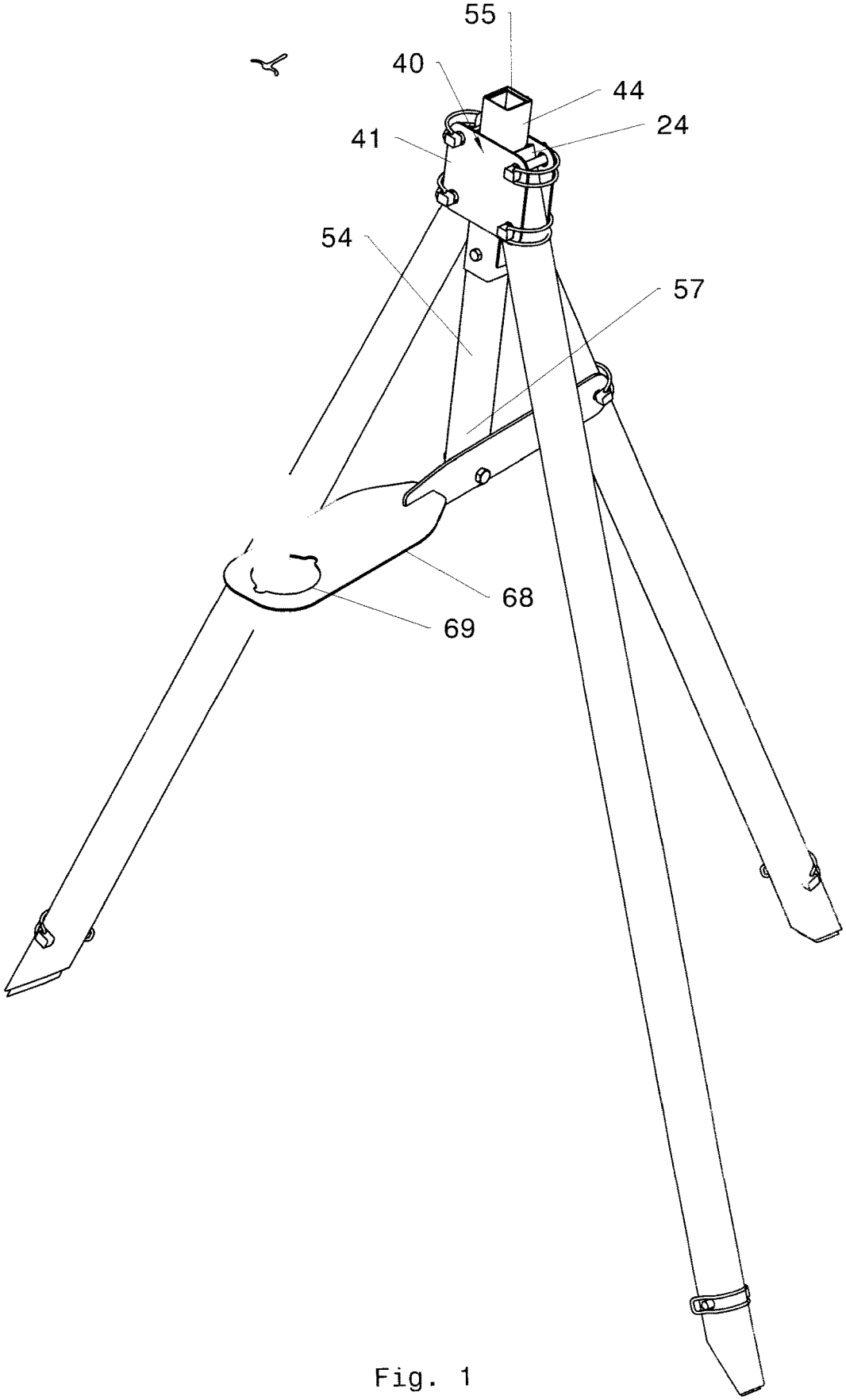
FIG. 1 is a perspective view of a representative sample of the guide apparatus of the present invention, in an operational configuration without any leg extended, and showing an unclaimed T-post in broken line.
Figure 2:
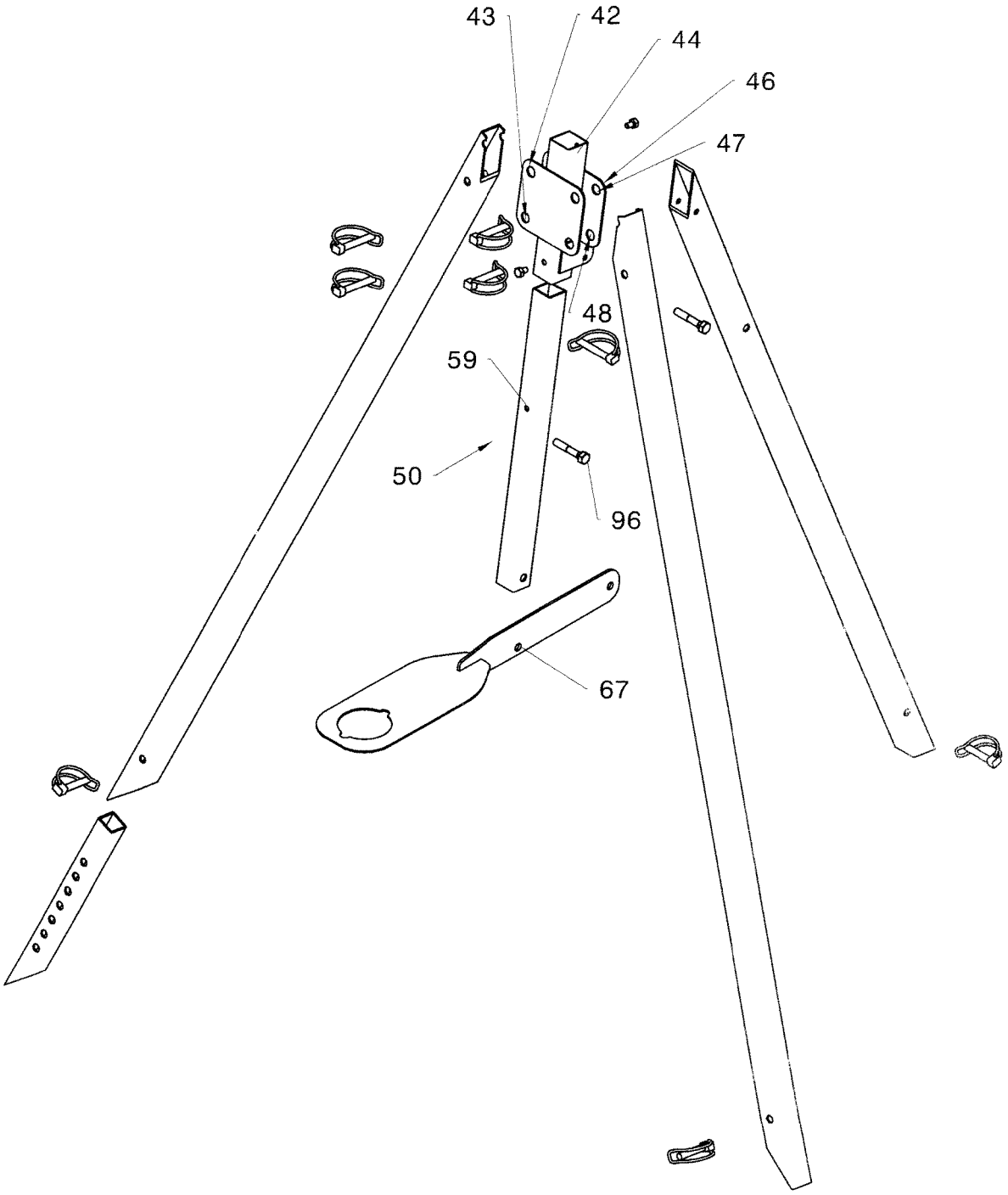
FIG. 2 is an exploded view of FIG. 1, without the T-post but with one leg extended downward and the other two leg extensions not shown.
Figure 3:
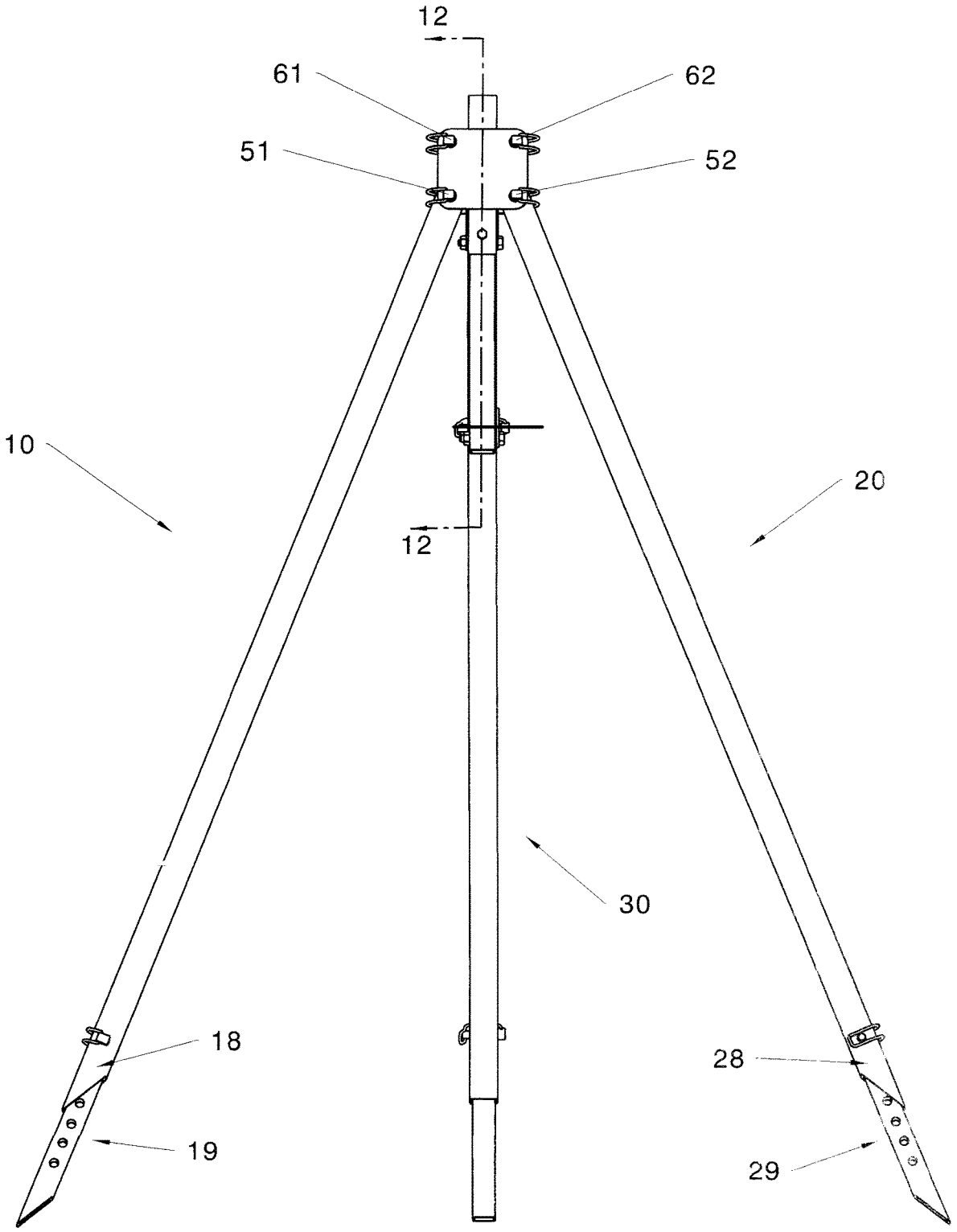
FIG. 3 is a front elevation view of the apparatus of FIG. 2, unexploded and with all three legs extended.
Figure 4:
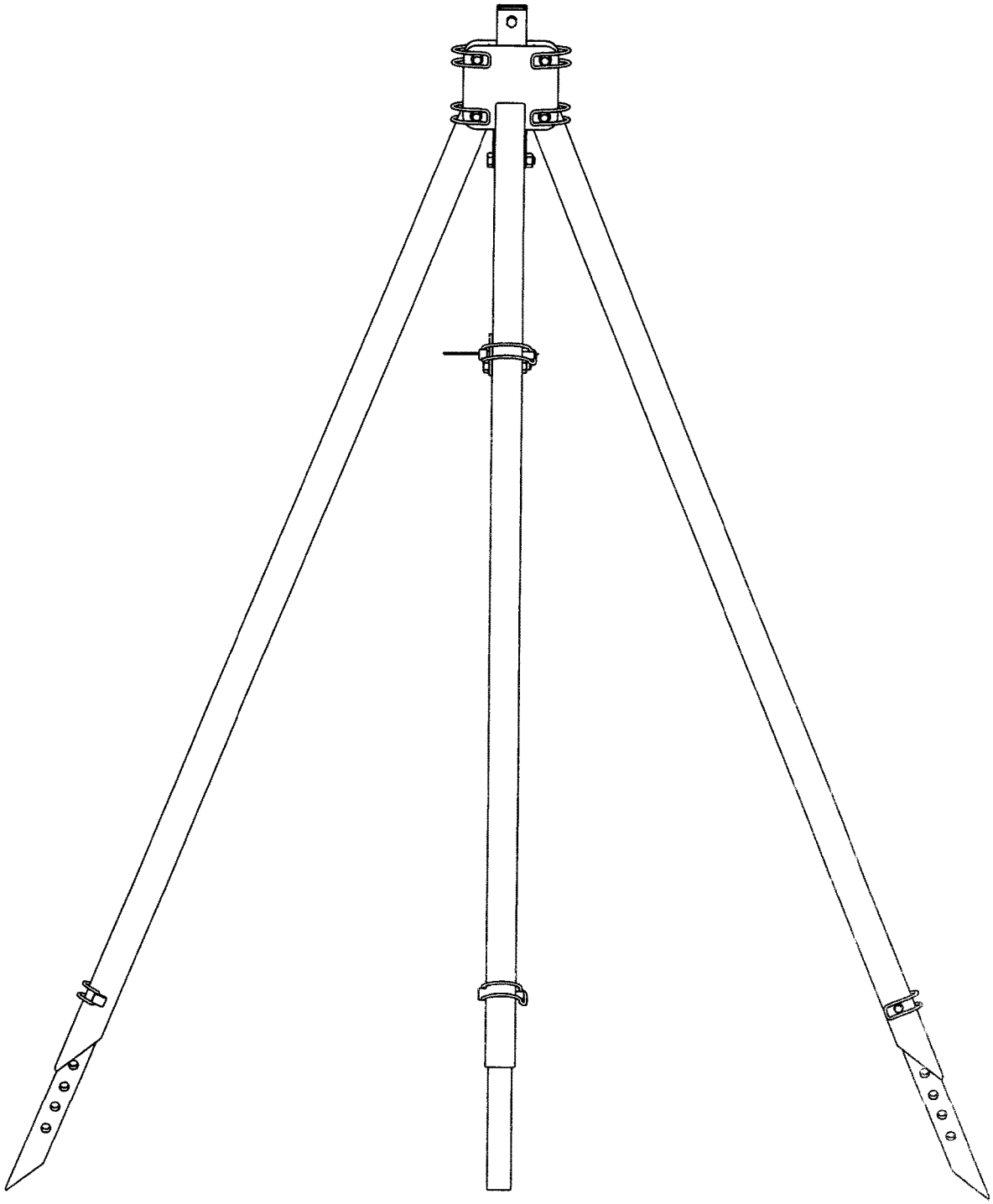
FIG. 4 is a rear elevation view of the apparatus of FIG. 3.
Figure 5:
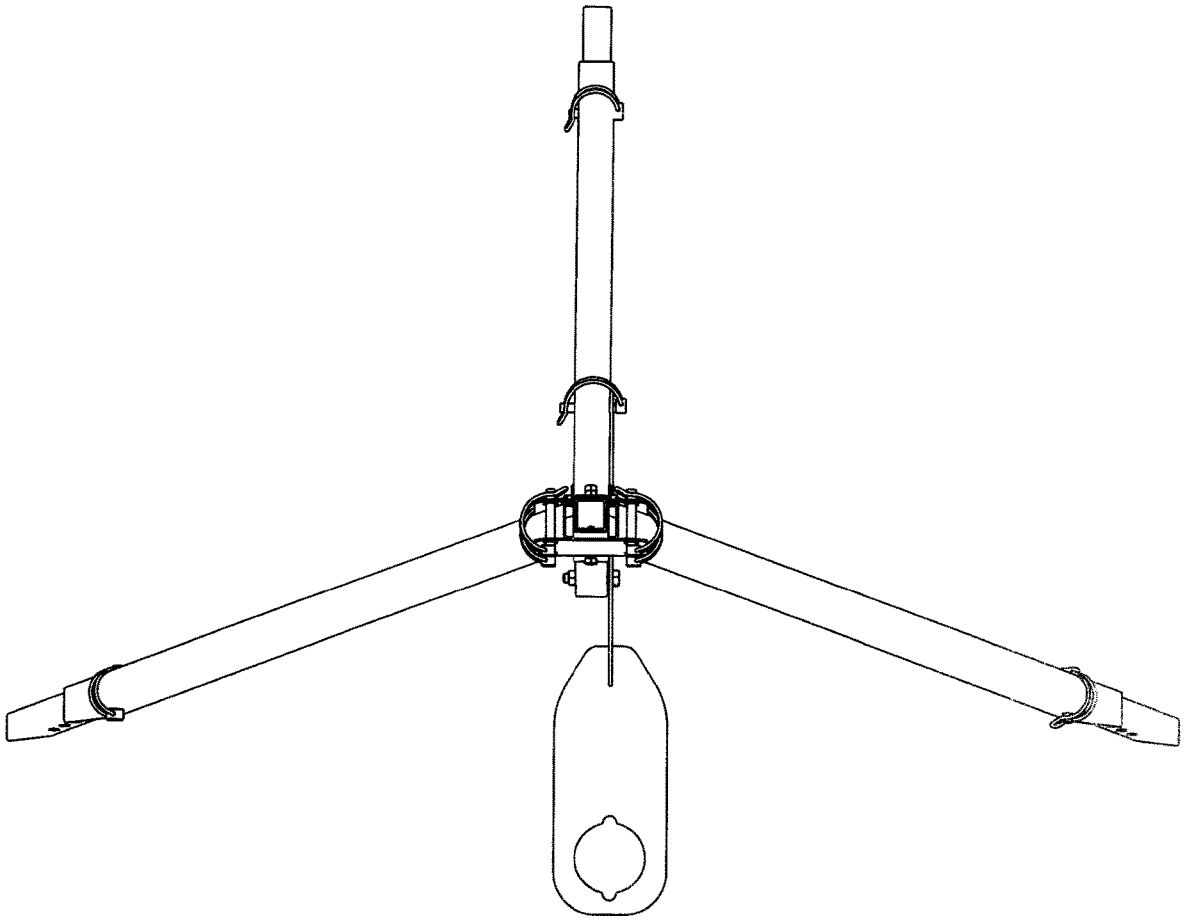
FIG. 5 is a top plan view of the apparatus of FIG. 3.
Figure 6:
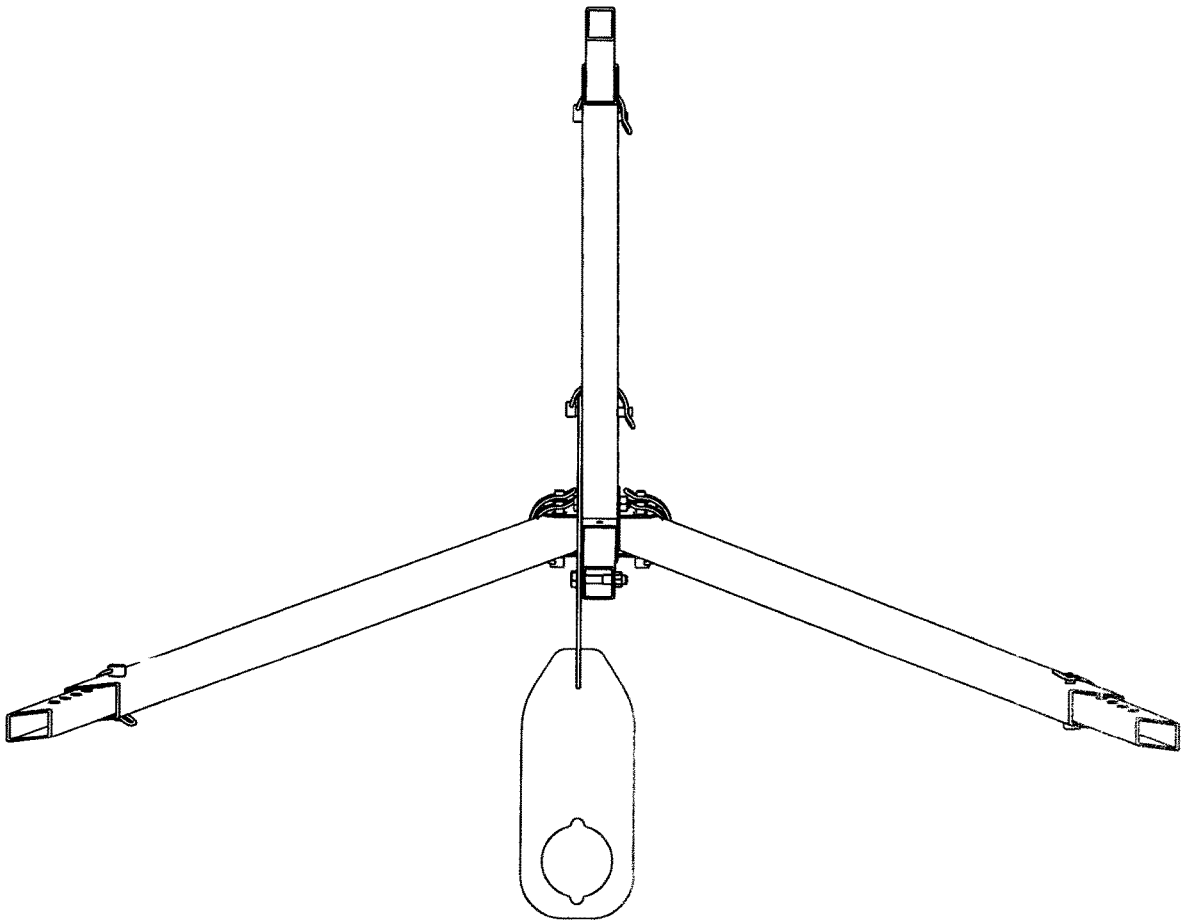
FIG. 6 is a bottom plan view of the apparatus of FIG. 3.
Figure 7:
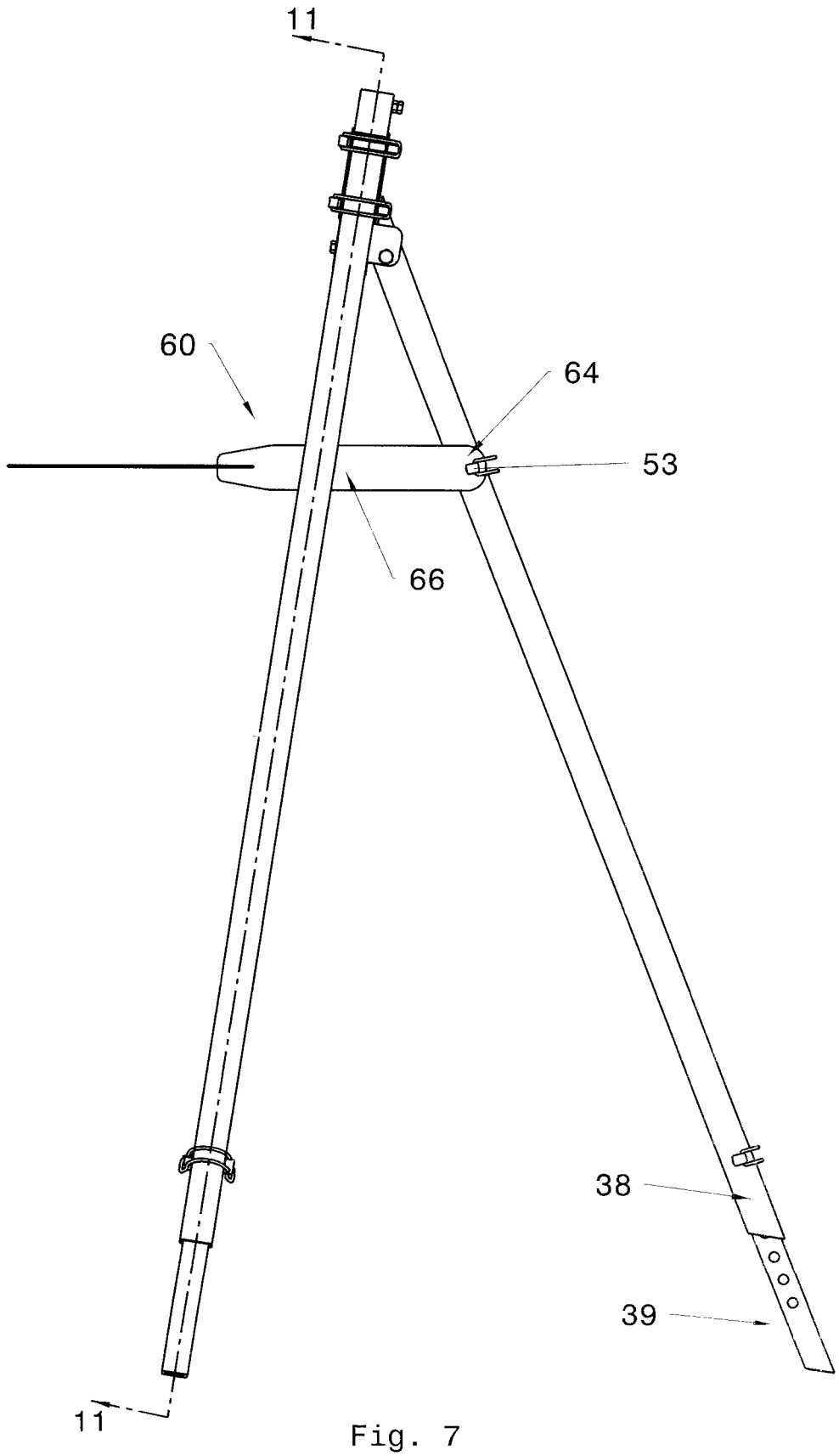
FIG. 7 is a side elevation view of the apparatus of FIG. 3.
Figure 8:
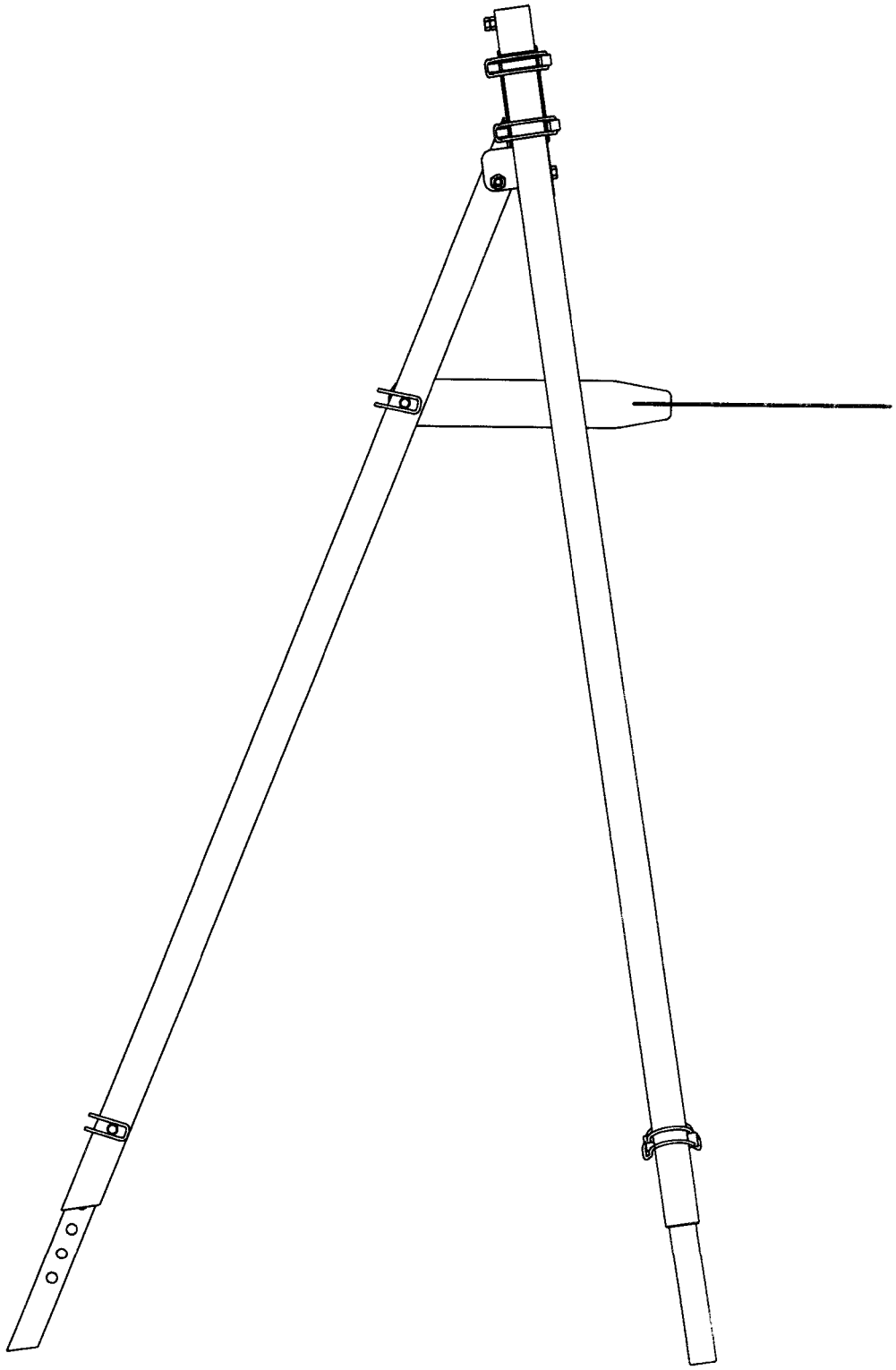
FIG. 8 is an opposite side elevation view of the apparatus of FIG. 2.
Figure 9:
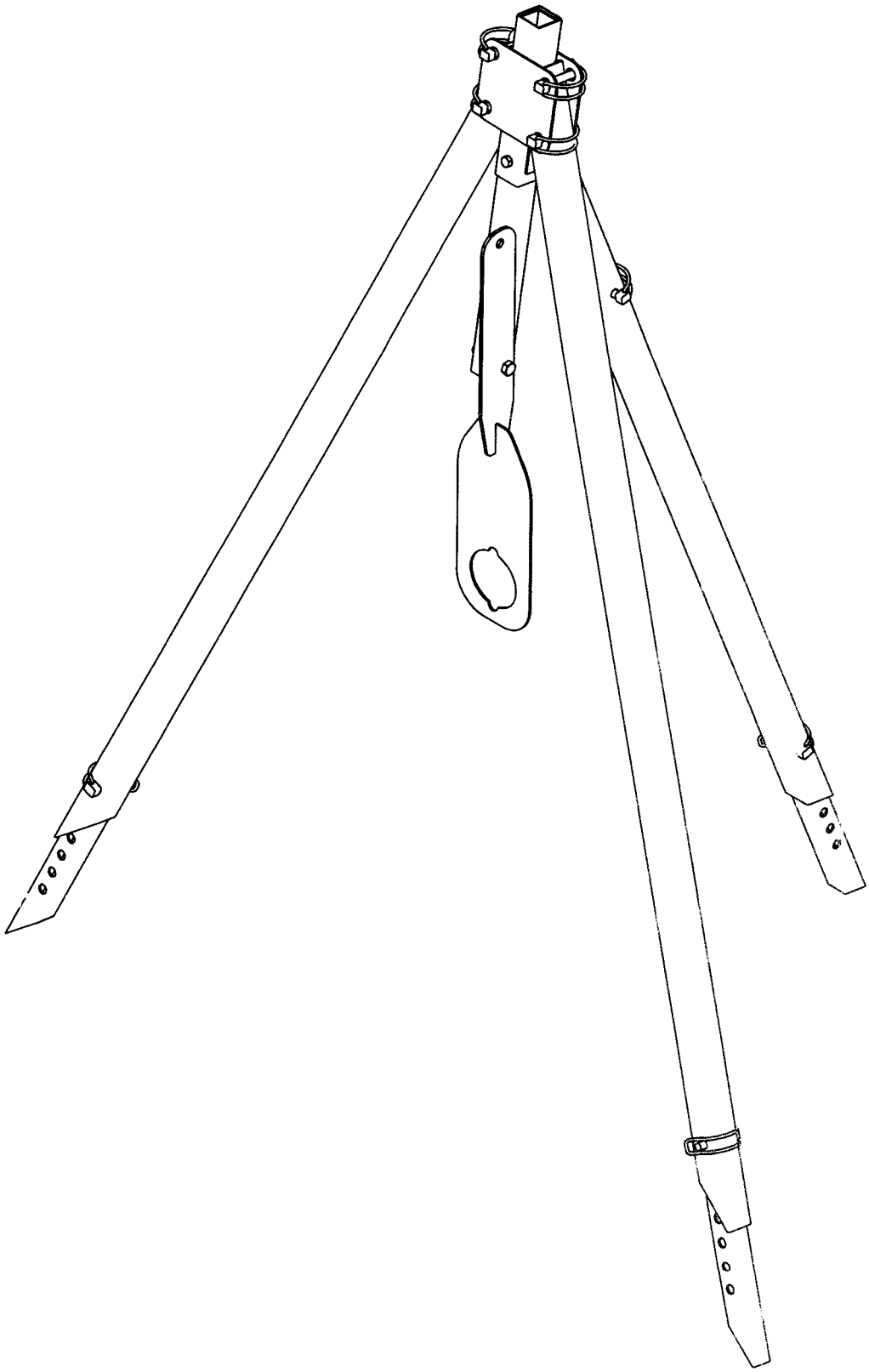
FIG. 9 is a perspective view of the apparatus of FIG. 3, with the stabilizer guide (paddle) disconnected from the third leg (and pivotally situated essentially vertically).
Figure 10:
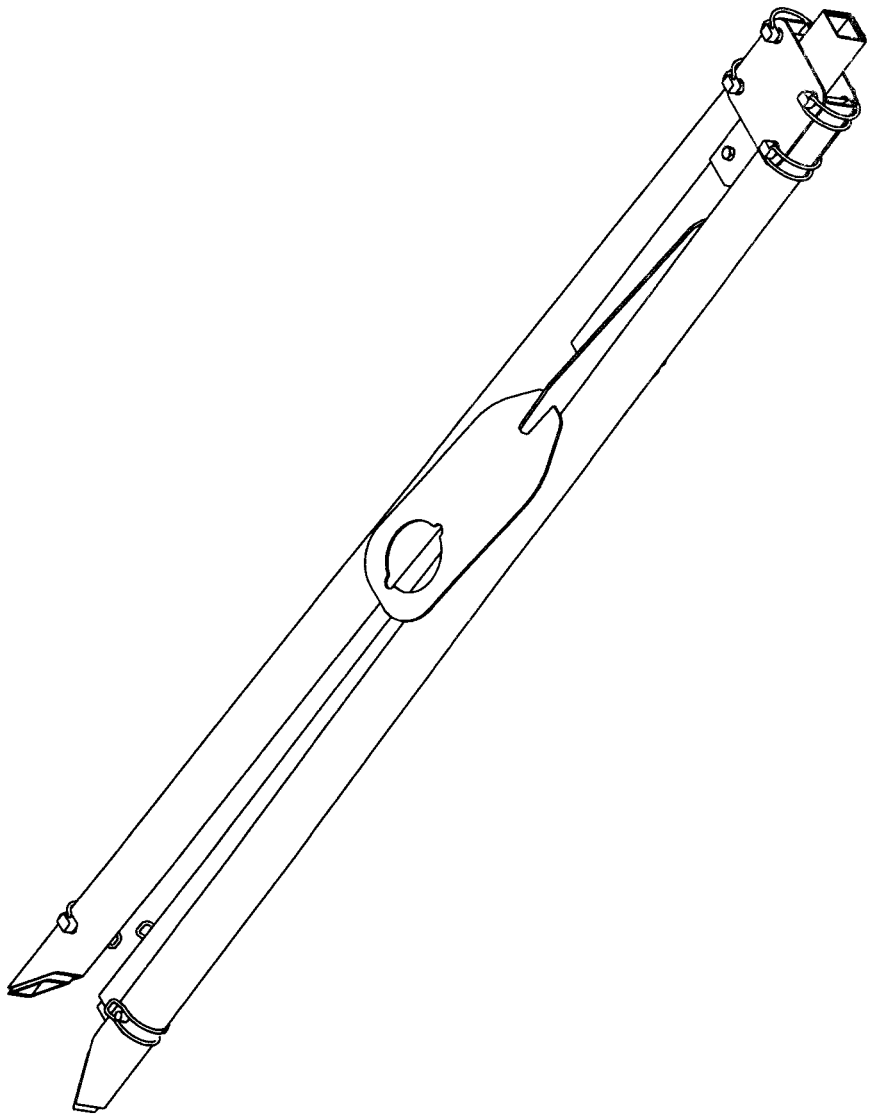
FIG. 10 is a perspective view of the apparatus of FIG. 3, in a compacted (non-operational) configuration.
Figure 11:
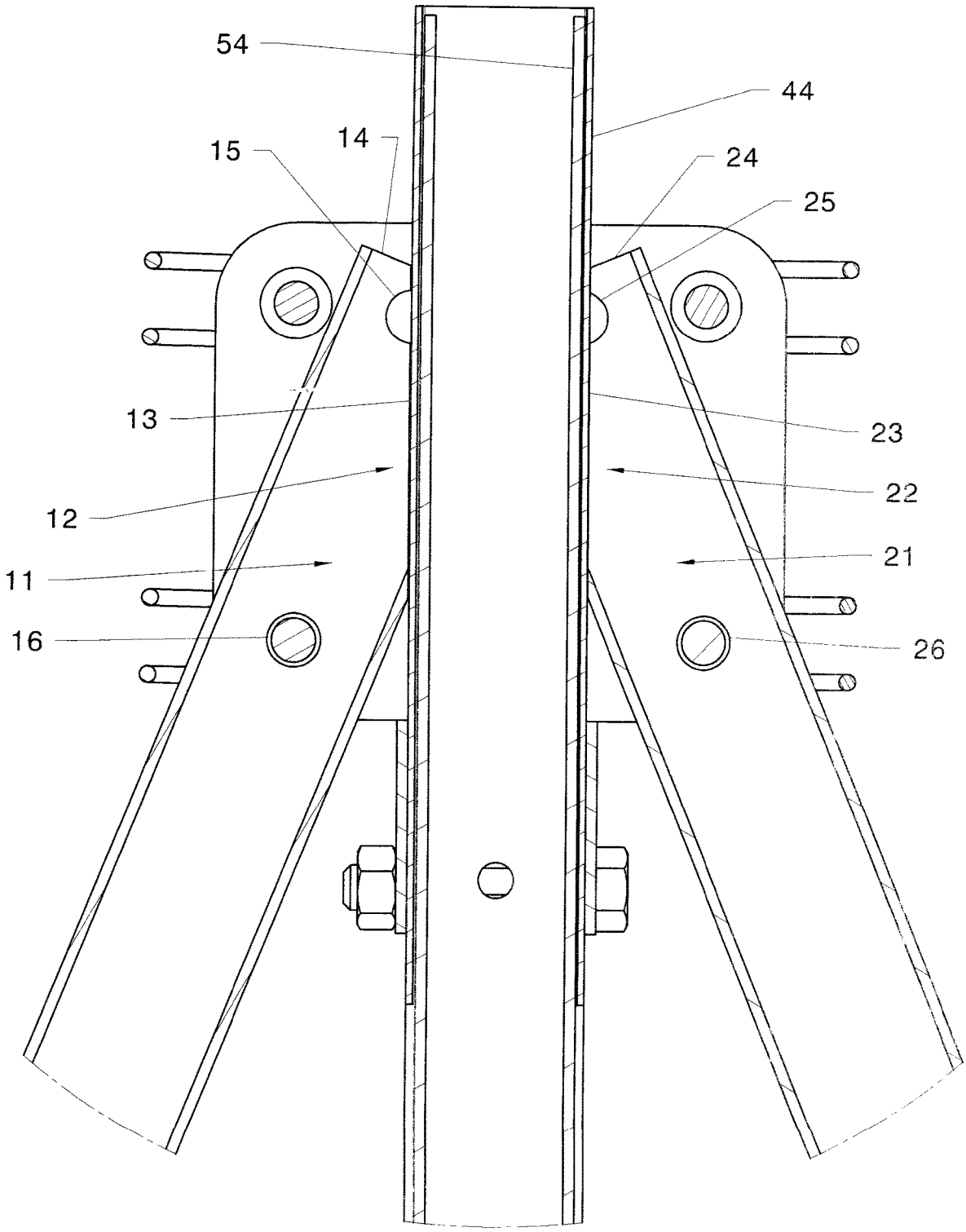
FIG. 11 is a close-up partial cross-section view showing the assembly head and connection ends of the legs and support sleeve of the apparatus of FIG. 3, from plane 11-11 of FIG. 7.
Figure 12:
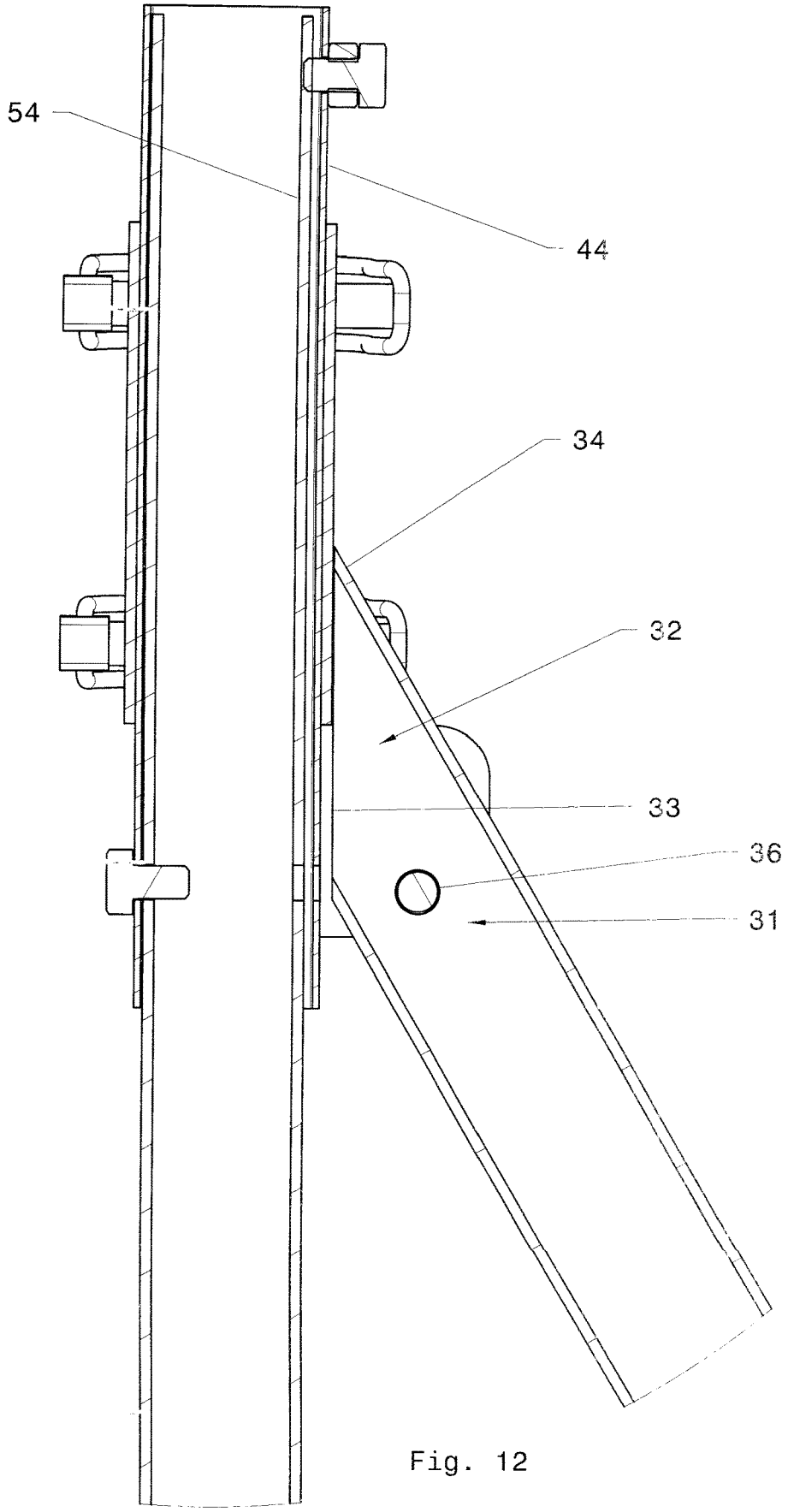
FIG. 12 is a close-up partial cross-section view showing the assembly head and connection end of the third leg and support sleeve of the apparatus of FIG. 3, from plane 12-12 of FIG. 3.
Figure 13:
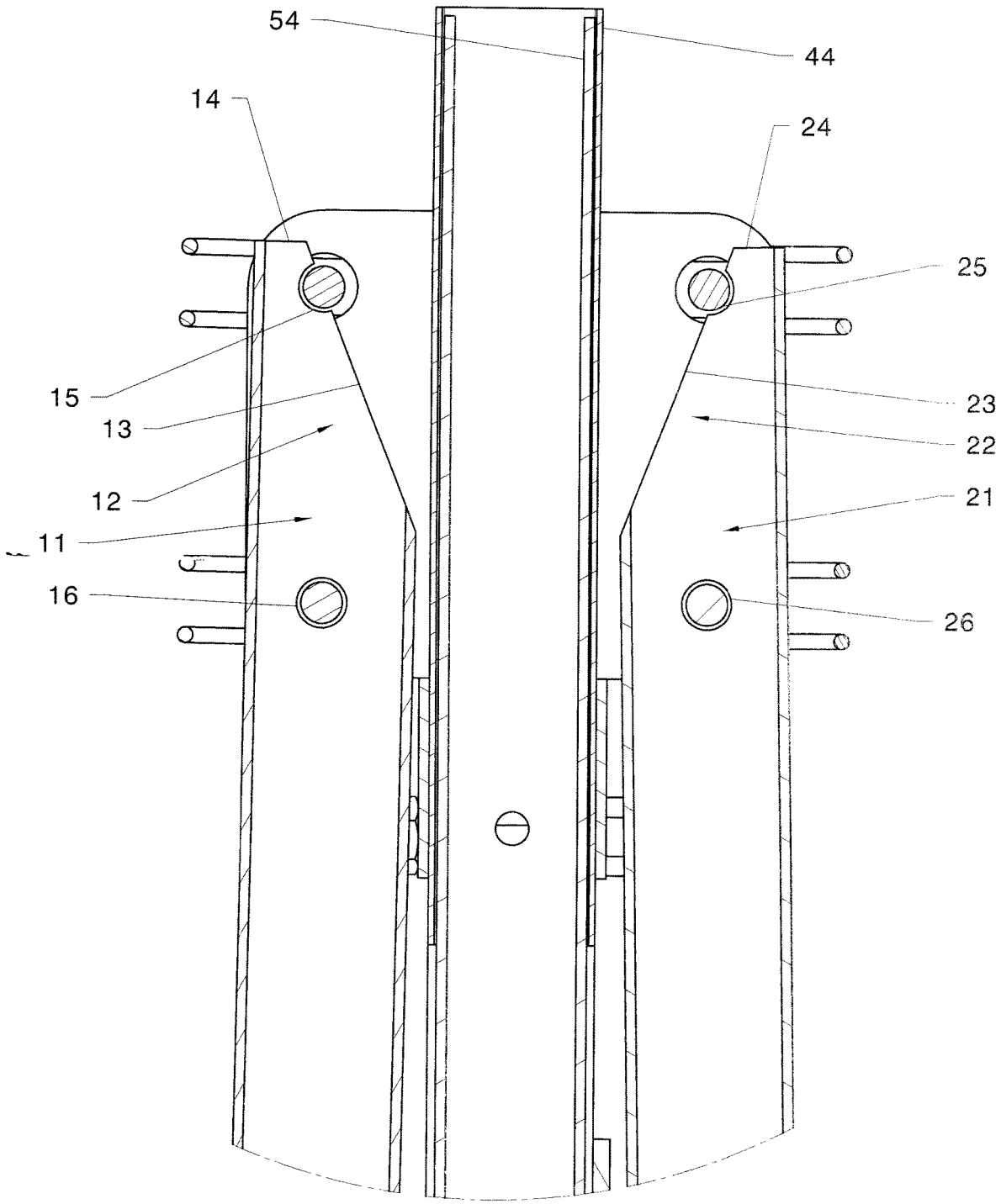
FIG. 13 is the view of FIG. 11 with the apparatus in a compacted (non-operational) configuration.
Figure 14:
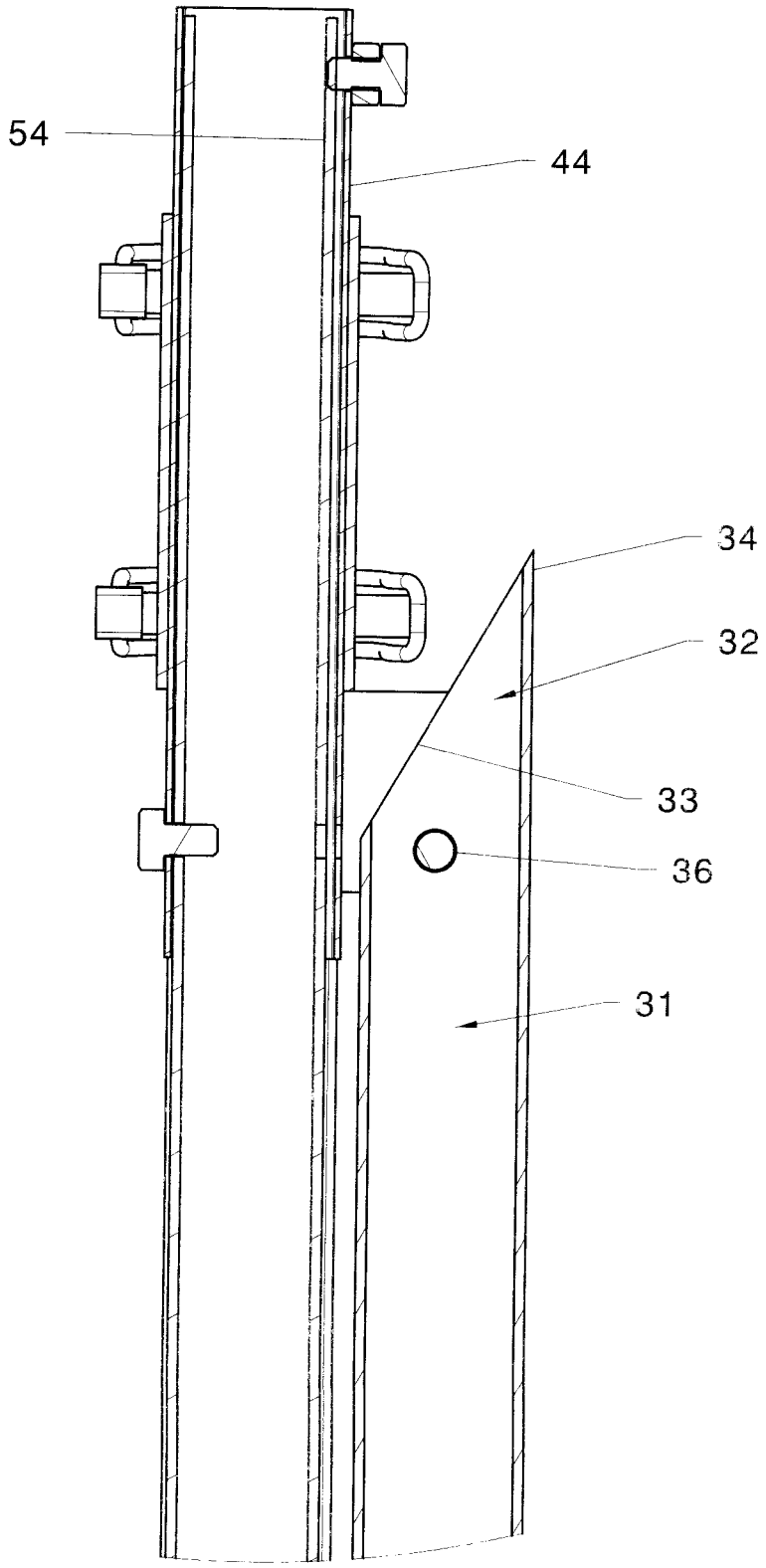
FIG. 14 is the view of FIG. 12 with the apparatus in a compacted (non-operational) configuration.

The terminology used herein is for the purpose of describing particular embodiments only and is not intended to be limiting. As used herein, the singular forms "a", "an", and "the" are intended to include the plural forms as well, unless the context clearly indicates otherwise; for example, fluid pathway can mean either a single pathway or multiple pathways. It will be further understood that the terms "comprises" and/or "comprising", or "includes" and/or "including", or "have" or "having", when used in this specification, specify the presence of stated features, regions, integers, steps, operations, elements and/or components, but do not preclude the presence or addition of one or more other features, regions, integers, steps, operations, elements, components and/or groups thereof.

For the sake of simplicity and to give the claims of this patent application the broadest interpretation and construction possible, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa, whenever necessary to give the claims of this patent application the broadest interpretation and construction possible.

It will be understood that, although the terms first, second, third, etc. may be used herein to describe various elements, these elements should not be limited by these terms. These terms are only used to distinguish one element from another element. Likewise, synonyms for the same element, term or concept may be used only to distinguish one similar element from another, unless the context clearly indicates otherwise.

The terms "fastener", "fastening means" and the like are intended to be non-limiting. For examine, those terms may mean a bolt including a threaded end receiving a nut, a pin having an end with a transverse bore therethrough for accepting a cotter pin or other type of pin, a pin having a transverse bore at one end having one end of an essentially U-shaped metal coupler threaded therethrough and with the other end of the U-shaped coupler capturing the opposite end of the pin, or any arrangement of structure(s) capable of fastening/connecting at least two other structures, either permanently or temporarily as indicated from the context of usage.

The disclosure herein is not limited by construction materials to the extent that other materials satisfy the structural and/or functional requirements. For example, any material may be used so long as it satisfies the functional and structural requirements for which it is being used. In one embodiment, the components of the apparatus are constructed of steel or other structural metallic material; however, any material may suffice as well, if it satisfies the functional and structural requirements for which it is being used. Likewise, the disclosed invention is not limited by any construction process or method.

In general, the invention disclosed herein includes (comprises) an apparatus expandable from a compact transport configuration to a free-standing use configuration for positioning a fence post essentially vertically to allow the user to manually drive it into the ground. In one general embodiment, the apparatus includes a compactable tri-pod-like assembly including an assembly head having means for connecting the legs.

Connecting to the assembly head (40) are:

(1) a pair of pivotable 1st and 2nd support legs (10 and 20), each having a foot end (18 and 28) and having an apex end (11 and 21) pivotably connected to the assembly head and essentially opposing the apex end of the other support leg;

(2) a 3rd pivotable support leg (30) having a 3rd foot end (38) and a 3rd apex end (31) pivotably connected to the assembly head and enabling the apparatus to stand when all three support legs are pivoted outwardly; and (3) a stabilizer support (50) downstanding from the assembly head, and comprising a lower connection end (57).

For bracing the tri-pod and holding the post in an essentially vertical orientation awaiting driving, there is also a stabilizer guide member (60) comprising:

(1) a middle portion (66) pivotably connected to the lower connection end (57) of the stabilizer support;

(2) a stabilizer end (64) pivotably connected to the 3rd support leg; and (3) an opposite guide end (68) defining an aperture (69) sized to accept insertion of the unclaimed fence post in a manner positioning it essentially vertically for commencement of the user manually driving it into the ground but facilitating lifting of the apparatus off the partially driven post without altering the vertical positioning thereof.

In one specific embodiment of the invention, the apparatus described herein includes the pivotable 1st and 2nd support legs oriented to pivot apart in substantially the same plane. The 3rd pivotable support leg may then be oriented to pivot outwardly in a plane essentially perpendicular to the plane of the pivotable 1st and 2nd support legs.

The assembly head may further comprise a pair of essentially parallel front and back support plates (41 and 46), each support plate including a lower hole (43 and 48) aligned with a corresponding lower hole of the other support plate. Each of the pivotable 1st and 2nd support leg's apex ends may have a cross-sectional area defined by the outer surfaces, and each apex end of the respective 1st and 2nd support legs may further comprise a converging tip region (12 and 22) including a terminal tip (14 and 24). One surface of the support leg may also include a diagonal planar cutaway (13 and 23), reducing the cross-sectional area as the tip is approached, thereby essentially converging the apex end of the support leg into a narrowing tip end.

The apex end of each respective support leg also includes a lower bore (16 and 26) aligned with the aligned lower holes of the front and back support plates; each respective lower bore and lower holes receive a hinge pin (51 and 52) enabling the support leg to pivot from a vertical compacted position outwardly to a free-standing use position.

The pair of essentially parallel front and back support plates may further include an upper hole (42 and 47) aligned with a corresponding upper hole of the other support plate. Each of the converging tip regions of the respective pivotable 1st and 2nd support legs may further include an upper bore (15 and 25) aligned with the upper holes and near the tip, and situated along a plane closely parallel to the diagonal planar cutaway. Each respective upper bore and upper holes may receive a removable fastening pin so that, when a support leg is in the vertical compacted position, the upper holes of the opposing support plates are aligned with the upper bore near the tip, so that inserting the fastening pin therethrough locks the leg in the compacted position; on the other hand, inserting the fastening pin through the upper holes in the support plates when the leg is in the free-standing position chocks against the outer surface of the leg near its tip, to fix the leg in the free-standing position.

The removable fastening pin may also include a fastener end configured to accept a removable fastener. The removable fastener may be selected from the group consisting of a nut for external threading, a cotter pin for a transverse aperture through the fastener end, and/or other removable fasteners, and combinations thereof.

The apparatus may further include angulation adjustment means for adjusting the angulation of the stabilizer guide member, thereby adjusting the size of the aperture sized to accept insertion of the unclaimed fence post. The size of the opening of the post-accepting aperture (69), on the guide end of the stabilizer guide member, is largest when the stabilizer guide member is in a horizontal orientation. The size of that opening changes however, as the stabilizer guide member is moved away from that horizontal plane. The perceived diameter of the typical circle or oval, when viewed from directly above or below the opening, decreases as the stabilizer guide member approaches a more vertical orientation. The user may adjust the orientation of the stabilizer guide member to decrease that aperture's vertical opening to the extent desired to hold the post in an essentially vertical orientation for commencing driving. Moreover, when the stabilizer guide member is in a diagonal orientation, the edge of the aperture may be set to touch the post on opposite sides, with one touch-point higher than the other touch-point, thereby providing additional stabilizing guidance. When ready to remove the apparatus, the user can then re-adjust the orientation of the stabilizer guide member to increase the perceived diameter of the aperture, so that the apparatus can be lifted off the partially-driven post for completion of driving.

The angulation adjustment means may be selected from the group consisting of: (1) means of varying the connection point where the stabilizer end of the stabilizer guide member pivotably connects to the 3rd support leg, or (2) means for varying the height of the lower connection end of the stabilizer support downstanding from the assembly head, or (3) means for varying the length of the support legs, and combinations thereof.

The means of varying the connection point, where the stabilizer end of the stabilizer guide member pivotably connects to the 3rd support leg, may involve the 3rd support leg including a plurality of periodically spaced bore-holes (not shown); and the stabilizer end may include a longitudinal slot or periodically spaced holes (not shown) in cooperating relationship with the bore-holes for receiving a fastening means extending therethrough for firmly connecting the stabilizer end (64) and the 3rd support leg at a location yielding the desired angulation of the stabilizer guide member.

The means for varying the height of the lower connection end of the stabilizer support downstanding from the assembly head may involve the stabilizer support including an elongate vertical sleeve (44) fixed between the support plates (41 and 46), and telescopically accepting a strut (54) affixed therein and downstanding therefrom. Both the sleeve and the strut may further include a plurality of aligned and periodically spaced throughways (not shown) accepting insertion of a fastener therethrough to vary the length of the stabilizer support.

The means for varying the length of the support legs may involve each of the support legs defining a hollow lumen telescopically accepting an extender (19, 29 and 39) therein. Both support leg and extender may further include a plurality of aligned and periodically spaced throughways (not shown) accepting insertion of a fastening means after the extender is extending beyond the lumen, to vary the length of the respective support leg.

One specific embodiment of the apparatus, expandable from a compact transport configuration to a free-standing use configuration for positioning a fence post essentially vertically to allow the user to manually drive it into the ground, includes a compactable assembly comprising:

(a) an assembly head comprising a connecting means for connecting:
  (1) a pair of essentially parallel front and back support plates (41 and 46), each support plate including a lower hole (43 and 48, respectively) aligned with a corresponding lower hole of the other support plate;
  (2) a pair of pivotable 1st and 2nd support legs, each having a respective 1st and 2nd foot end (18 and 28) and a respective 1st and 2nd apex end pivotably connected to the assembly head and essentially opposing the apex end of the other support leg, each of the pivotable 1st and 2nd support leg's apex ends defining a cross-sectional area, each apex end of the respective 1st and 2nd support legs may further include a converging tip region (12 and 22) comprising a terminal tip (14 and 24), and including:
    (A) a diagonal planar cutaway (13 and 23) reducing the cross-sectional area as the tip is approached; and
    (B) a lower bore (16 and 26) aligned with the aligned lower holes (43 and 48) of the front and back support plates, each respective lower bore and lower holes receiving a hinge pin (51 and 52) enabling the support leg to pivot from a vertical compacted position outwardly to a free-standing use position;
  (3) a 3rd pivotable support leg having a 3rd foot end (38) and a 3rd apex end pivotably connected 36 to the assembly head and enabling the apparatus to stand when all three support legs are pivoted outwardly; and (4) a stabilizer support (50) comprising a vertical sleeve (44) fixed between the support plates and telescopically accepting a strut (54) affixed therein and downstanding therefrom, and comprising a lower connection end (57); and (b) a stabilizer guide member (60) comprising:

(1) a middle portion pivotably connected to the lower connection end of the stabilizer support;

(2) a stabilizer end (64) pivotably connected to the 3rd support leg; and (3) an opposite guide end (68) defining an aperture (69) sized to accept insertion of the unclaimed fence post in a manner positioning it essentially vertically for commencement of the user manually driving it into the ground but facilitating lifting of the apparatus off the partially driven post without altering the vertical positioning thereof.

The apparatus may further include angulation adjustment means for adjusting the angulation of the stabilizer guide member.

Additionally the pair of essentially parallel support plates may further include an upper hole aligned with a corresponding upper hole of the other support plate. each of the converging tip regions of the respective pivotable 1st and 2nd support legs may further include an upper bore aligned with the upper holes and near the tip, and along a plane closely parallel to the diagonal planar cutaway, each respective upper bore and upper holes receiving a removable fastening pin. When a support leg is in the vertical compacted position, the upper holes of the opposing support plates are aligned with the upper bore near the tip, so that inserting the fastening pin therethrough locks the leg in the compacted position, while inserting the fastening pin through the upper holes in the support plates when the leg is in the free-standing position chocks against the leg to fix the leg in the free-standing position.

The angulation adjustment means for adjusting the angulation of the stabilizer guide member comprises means of varying the connection point where the stabilizer end of the stabilizer guide member pivotably connects to the 3rd support leg includes the 3rd support leg having a plurality of periodically spaced bore-holes. The stabilizer end may include a longitudinal slot or periodically spaced holes in cooperating relationship with the bore-holes for receiving a fastening means extending therethrough for firmly connecting the stabilizer end and the 3rd support leg at a location yielding the desired angulation of the stabilizer guide member.

Alternatively, the angulation adjustment means for adjusting the angulation of the stabilizer guide member may include means for varying the height of the lower connection end of the stabilizer support downstanding from the assembly head comprising the stabilizer support including an elongate vertical sleeve fixed between the support plates and telescopically accepting a strut affixed therein and downstanding therefrom, both the sleeve and the strut may further include a plurality of aligned and periodically spaced throughways accepting insertion of a fastener therethrough to vary the length of the stabilizer support.

Alternatively, the angulation adjustment means for adjusting the angulation of the stabilizer guide member may include means for varying the length of the support legs, including each of the support legs defining a hollow lumen telescopically accepting an extender therein. Both support leg and extender may further include a plurality of aligned and periodically spaced throughways accepting insertion of a fastening means after the extender is extending beyond the lumen, to vary the length of the respective support leg.

Although the apparatus may assemble the apparatus in a number of manners or sequences, the following has proven efficient:

(1) position each support leg's apex end between the front and back support plates, and align each leg's lower bore with the lower holes of the front and back support plate;

(2) thread the hinge pin for each respective support leg through the aligned lower bore and lower holes, and affix a fastener on the leading end of the hinge pin;

(3) if you want the apparatus to be in the use configuration, pivot the 1st and 2nd support legs outwardly at each's foot, then insert the fastening pin through the aligned upper holes of the front and back support plates to chock each respective 1st and 2nd support leg in a wide stance; then pivot the 3rd support leg outwardly to stabilize the tri-pod;

(4) insert the stabilizer support/strut into the assembly head sleeve to the appropriate amount of downward extension of the lower connection end of the strut, and tighten the compression screw against the strut to affix it into place;

(5) thread the pivot pin through the hole in the mid portion of the stabilizer guide member, and then through the bore-hole of the lower connection end of the stabilizer support, and affix a fastener to the leading end; and (6) align a hole in the stabilizer end of the stabilizer guide member, with the bore-hole in the 3rd support leg, then thread a fastening pin through and affix a fastener to the leading end.

If you want the apparatus to be in the compacted travel/storage configuration, undo steps (5) and (6) above; and in step 3 above, pivot the 1st and 2nd support legs together, then insert the fastening pin through the upper holes of the front and back support plates aligned with the upper bore, to lock each respective 1st and 2nd support leg in a narrow stance; then pivot the 3rd support leg inwardly.

While a preferred embodiment of the present invention has been described, it should be understood that various changes, adaptations and modifications may be made therein without departing from the spirit of the invention. Changes may be made in details, particularly in matters of shape, size, material, and arrangement of parts without exceeding the scope of the invention.

While the forms of apparatus herein described constitute preferred embodiments of the invention, it is to be understood that the invention is not limited to these precise forms of apparatus, and that changes may be made therein without departing from the scope and spirit of the invention as defined in the appended claims.

Those skilled in the art will recognize improvements and modification to the preferred embodiments of the present disclosure. All such improvements and modifications are considered within the scope of the concepts disclosed herein and the claims that follow.

I claim:

1. An apparatus expandable from a compact transport configuration to a free-standing use configuration for positioning a post essentially vertically to allow the user to manually drive said unclaimed post into the ground, said apparatus comprising a compactable assembly comprising:

(a) an assembly head comprising a connecting means for connecting:

(1) a pair of pivotable 1st and 2nd support legs, each having a foot end and having an apex end pivotably connected to the assembly head and essentially opposing the apex end of the other support leg;

(2) a 3rd pivotable support leg having a 3rd foot end and a 3rd apex end pivotably connected to the assembly head; and (3) a stabilizer support downstanding from the assembly head, and comprising a lower connection end; and (b) a stabilizer guide member comprising:

(1) a middle portion pivotably connected to said lower connection end of said stabilizer support;

(2) a stabilizer end pivotably connected to said 3rd support leg; and (3) an opposite guide end defining an aperture sized to accept insertion of the post in a manner positioning the post essentially vertically for commencement of the user manually driving the post into the ground but facilitating lifting of the apparatus off the partially driven post without altering the vertical positioning thereof.

2. The apparatus described in claim 1 above, said pivotable 1st and 2nd support legs oriented to pivot apart in substantially the same plane.

3. The apparatus described in claim 2 above, said 3rd pivotable support leg oriented to pivot outwardly in a plane essentially perpendicular to said plane of the pivotable 1st and 2nd support legs.

4. The apparatus described in claim 1 above, wherein:

(a) said assembly head further comprising a pair of essentially parallel front and back support plates, each support plate including a lower hole aligned with a corresponding lower hole of the other support plate;

(b) each of said pivotable 1st and 2nd support leg's apex ends defining a cross-sectional area, each apex end of the respective 1st and 2nd support legs further comprising a converging tip region comprising a terminal tip, and:

(1) a diagonal planar cutaway reducing said cross-sectional area as said terminal tip is approached; and (2) a lower bore aligned with said aligned lower holes of the support plates, each respective lower bore and lower holes receiving a hinge pin enabling said support leg to pivot from a vertical compacted position outwardly to a free-standing use position.

5. The apparatus described in claim 4 above, wherein:

(a) said pair of essentially parallel front and back support plates further comprising an upper hole aligned with a corresponding upper hole of the other support plate;

(b) each of said converging tip regions of the respective pivotable 1st and 2nd support legs further comprising an upper bore aligned with said upper holes and near the terminal tip, and along a plane closely parallel to said diagonal planar cutaway, each respective upper bore and upper holes receiving a removable fastening pin;

wherein, when the respective 1st or 2nd support leg is in the vertical compacted position, said respective upper holes of said opposing support plates are aligned with said respective upper bore near said terminal tip, so that inserting said fastening pin therethrough locks the respective leg in the compacted position, while inserting said fastening pin through the respective upper holes in the support plates when the respective leg is in the free-standing position chocks against the respective leg to fix the leg in the free-standing position.

6. The apparatus described in claim 5 above, said removable fastening pin comprising a fastener end configured to accept a removable fastener.

7. The apparatus described in claim 6 above, said removable fastener selected from the group consisting of a nut for external threading, a cotter pin for a transverse aperture through said fastener end, or other removable fasteners, and combinations thereof.

8. The apparatus described in claim 4 above, said apparatus further comprising angulation adjustment means for adjusting the angulation of the stabilizer guide member, thereby adjusting the size of the aperture sized to accept insertion of the unclaimed post.

9. The apparatus described in claim 8 above, said angulation adjustment means selected from the group consisting of means of varying the connection point where the stabilizer end of the stabilizer guide member pivotably connects to the 3rd support leg, or means for varying the height of the lower connection end of the stabilizer support downstanding from the assembly head, or means for varying the length of the three support legs independently, and combinations thereof.

10. The apparatus described in claim 9 above, said means of varying the connection point where the stabilizer end of the stabilizer guide member pivotably connects to the 3rd support leg comprising the 3rd support leg including a plurality of periodically spaced bore-holes, and the stabilizer end including a longitudinal slot or periodically spaced holes in cooperating relationship with said bore-holes for receiving a fastening means extending therethrough for firmly connecting the stabilizer end and the 3rd support leg at a location yielding the desired angulation of the stabilizer guide member.

11. The apparatus described in claim 9 above, said means for varying the height of the lower connection end of the stabilizer support downstanding from the assembly head comprising the stabilizer support including an elongate vertical sleeve fixed between said support plates and telescopically accepting a strut affixed therein and downstanding therefrom, both the sleeve and the strut further comprising a plurality of aligned and periodically spaced throughways accepting insertion of a fastener therethrough to vary the length of the stabilizer support.

12. The apparatus described in claim 9 above, said means for varying the length of the three support legs comprising each of said three support legs defining a hollow lumen telescopically accepting an extender therein, both respective support leg and extender further comprising a plurality of aligned and periodically spaced throughways accepting insertion of a fastening means after the extender is extending beyond the lumen, to vary the length of the respective support leg.

13. An apparatus expandable from a compact transport configuration to a free-standing use configuration for positioning an unclaimed post essentially vertically to allow the user to manually drive the post into the ground, said apparatus comprising a compactable assembly comprising:

(a) an assembly head comprising a connecting means for connecting:

(1) a pair of essentially parallel front and back support plates, each support plate including a lower hole aligned with a corresponding lower hole of the other support plate;

(2) a pair of pivotable 1st and 2nd support legs, each having a respective 1st and 2nd foot end and a respective 1st and 2nd apex end pivotably connected to the assembly head and essentially opposing the apex end of the other respective 1st or 2nd support leg, each of said pivotable 1st and 2nd support leg's apex ends defining a cross-sectional area, each apex end of the respective 1st and 2nd support legs further comprising a converging tip region comprising a terminal tip, and including:

(A) a diagonal planar cutaway reducing said cross-sectional area as said terminal tip is approached; and (B) a lower bore aligned with said aligned lower holes of the front and back support plates, each respective lower bore and lower holes receiving a hinge pin enabling said respective 1st or 2nd support leg to pivot from a vertical compacted position outwardly to a free-standing use position;

(3) a 3rd pivotable support leg having a 3rd foot end and a 3rd apex end pivotably connected to the assembly head and enabling the apparatus to stand when all three support legs are pivoted outwardly; and (4) a stabilizer support comprising a vertical sleeve fixed between said support plates and telescopically accepting a strut affixed therein and downstanding therefrom, and comprising a lower connection end; and (b) a stabilizer guide member comprising:

(1) a middle portion pivotably connected to said lower connection end of said stabilizer support;

(2) a stabilizer end pivotably connected to said 3rd support leg; and (3) an opposite guide end defining an aperture sized to accept insertion of the post in a manner positioning the post essentially vertically for commencement of the user manually driving the post into the ground but facilitating lifting of the apparatus off the partially driven post without altering the vertical positioning thereof;

said apparatus further comprising angulation adjustment means for adjusting the angulation of the stabilizer guide member.

14. The apparatus described in claim 13 above, wherein:

(a) said pair of essentially parallel support plates further comprising an upper hole aligned with a corresponding upper hole of the other support plate;

(b) each of said converging tip regions of the respective pivotable 1st and 2nd support legs further comprising an upper bore aligned with said respective upper holes and near the terminal tip, and along a plane closely parallel to said diagonal planar cutaway, each respective upper bore and upper holes receiving a removable fastening pin;

wherein, when a respective 1st or 2nd support leg is in the vertical compacted position, said respective upper holes of said opposing support plates are aligned with said respective upper bore near said terminal tip, so that inserting said fastening pin therethrough locks the respective 1st or 2nd support leg in the compacted position, while inserting said fastening pin through the respective upper holes in the support plates when the respective 1st or 2nd support leg is in the free-standing position chocks against the respective 1st or 2nd support leg to fix the respective 1st or 2nd support leg in the free-standing position.

15. The apparatus described in claim 14 above, said angulation adjustment means for adjusting the angulation of the stabilizer guide member comprising means of varying the connection point where the stabilizer end of the stabilizer guide member pivotably connects to the 3rd support leg comprising the 3rd support leg including a plurality of periodically spaced bore-holes, and the stabilizer end including a longitudinal slot or periodically spaced holes in cooperating relationship with said bore-holes for receiving a fastening means extending therethrough for firmly connecting the stabilizer end and the 3rd support leg at a location yielding the desired angulation of the stabilizer guide member.

16. The apparatus described in claim 14 above, said angulation adjustment means for adjusting the angulation of the stabilizer guide member comprising means for varying the height of the lower connection end of the stabilizer support downstanding from the assembly head comprising the stabilizer support including an elongate vertical sleeve fixed between said support plates and telescopically accepting a strut affixed therein and downstanding therefrom, both the sleeve and the strut further comprising a plurality of aligned and periodically spaced throughways accepting insertion of a fastener therethrough to vary the length of the stabilizer support.

17. The apparatus described in claim 14 above, said angulation adjustment means for adjusting the angulation of the stabilizer guide member comprising means for independently varying the length of the respective support legs comprising each of said three support legs defining a hollow lumen telescopically accepting an extender therein, both respective support leg and extender further comprising a plurality of aligned and periodically spaced throughways accepting insertion of a fastening means after the extender is extending beyond the lumen, to vary the length of the respective support leg.

* * * * *